United States Patent [19]

Buschkens et al.

[11] 4,409,252

[45] Oct. 11, 1983

[54] PROCEDURE FOR PACKAGING OF FOOD UNDER PROTECTIVE GAS IN SYNTHETIC CONTAINERS WITH FLEXIBLE TOPS

[75] Inventors: Guido Buschkens, Krefeld; Peter Nobis, Neuss, both of Fed. Rep. of Germany

[73] Assignee: Messer Griesheim GmbH, Frankfurt am Main, Fed. Rep. of Germany

[21] Appl. No.: 367,329

[22] Filed: Apr. 12, 1982

[51] Int. Cl.[3] ..... B65B 31/04; B65B 31/06

[52] U.S. Cl. ..... 426/396; 53/432; 53/433; 53/408; 53/109; 426/316; 426/392; 426/413; 426/418

[58] Field of Search ..... 53/432–434, 53/510–512, 403, 405, 408, 109, 79, 97; 426/396, 418, 419, 402, 392, 413, 316

[56] References Cited

U.S. PATENT DOCUMENTS

| | | | |
|---|---|---|---|
| Re. 27,872 | 1/1974 | Esty | 53/434 |
| 1,970,193 | 8/1934 | Riebel | 53/433 |
| 2,393,491 | 1/1946 | Wolf | 53/109 |
| 2,412,167 | 12/1946 | Minaker | 53/109 |
| 2,863,266 | 12/1958 | Moore | 53/434 |
| 2,863,267 | 12/1958 | Moore | 53/434 |
| 3,054,679 | 9/1962 | Bradford | 426/123 |
| 3,351,265 | 11/1967 | Miller | 426/129 |
| 3,360,382 | 12/1967 | Miller | 426/418 |
| 3,398,500 | 8/1968 | Inman | 53/432 |
| 3,407,078 | 10/1968 | Schlichter | 426/418 |
| 3,430,414 | 3/1969 | Ludwig et al. | 53/512 |
| 3,490,576 | 1/1970 | Alessi et al. | 53/432 |
| 3,659,393 | 5/1972 | Richter | 426/396 |
| 3,750,362 | 8/1973 | Kishpaugn et al. | 53/433 |
| 3,830,365 | 8/1974 | Krueger et al. | 53/433 |
| 4,009,552 | 3/1977 | Schlachter | 53/510 |
| 4,162,599 | 7/1979 | Kyle | 53/511 |

FOREIGN PATENT DOCUMENTS

| | | | |
|---|---|---|---|
| 52-591 | 1/1977 | Japan | 53/433 |
| 54-148690 | 11/1979 | Japan | 53/510 |
| 413094 | 7/1934 | United Kingdom | 53/432 |

*Primary Examiner*—Steven L. Weinstein

*Attorney, Agent, or Firm*—Connolly and Hutz

[57] ABSTRACT

Food is packaged under a protective gas in synthetic containers having flexible lids. The sequence of the packaging steps is product filling, lid application, flushing with a protective gas, and sealing the lid. The flushing takes place wherein the lid is affixed to the container edge at at least one location, while one side of the lid is slightly lifted so that the protective gas can be blown therein.

6 Claims, 5 Drawing Figures

1
2
3
4
5
6
7
8
8
9
10
11
12
13
14
15
16
17
18
19
20
21
22

PROCEDURE FOR PACKAGING OF FOOD UNDER PROTECTIVE GAS IN SYNTHETIC CONTAINERS WITH FLEXIBLE TOPS

BACKGROUND OF INVENTION

The invention concerns a procedure for packaging food under protective gas in synthetic material containers with flexible covers.

Such procedures are performed step by step and include as the packaging steps, the steps of filling the product into the containers, flushing with a protective gas, applying the covers, and welding the covers closed. The flushing with the protective gas takes place by blowing the protective gas, e.g. nitrogen, carbon dioxide, or argon, into the container filled with the product, from above via one or several gas nozzles. It is obvious that in such a procedure, great specific quantities of the protective gas will be required in order to fill the headroom in the container with protective gas. The container, filled with the product, usually has a headroom of from 50 to 100 ml, shaped as a flat plate of max. 10 mm thickness. A sufficient gas exchange in this open headroom is possible only if the flushing is performed with quantities of protective gas amounting to several times the volume of the headroom. This procedure is thus unsatisfactory, already from the point of view of requirements for protective gas. An additional disadvantage of this process is that it is impossible to avoid infiltration of oxygen from the air in the headroom filled with the protective gas. After the flushing with the protective gas, it takes an additional time of approx. 2 seconds until the container is provided with a cover. This idle time causes renewal of the gas exchange, the oxygen content increases again. Furthermore, when the cover is applied, even more air is forced into the headroom of the container and enclosed there.

SUMMARY OF INVENTION

Thus, the object of the invention is to create a procedure for packaging a food in synthetic material containers under protective gas, which procedure would be characterized by low specific consumption of protective gas and would prevent the infiltration of oxygen from the air into the headroom of the container, which is flushed with protective gas.

With a procedure for packaging food under protective gas into synthetic containers with flexible lids, according to which the work moments or packaging steps are product filling, protective gas flushing, lid application, and lid sealing. These steps are performed step by step. The object is accomplished according to the invention, thereby that the packaging steps are performed in the sequence of product filling, lid application, protective gas flushing, and lid sealing, whereby the lid is affixed to the edge of the container at least in one place, one side of the lid is slightly lifted, and the protective gas is then forced through the slot formed in this manner.

The attachment of the lid to the edge of the containers can be achieved by one or several spot welds. The lid can also be pressed down on the container edge and fixed in position by means of clamps for holding down the lid that are used in the work moment. The lifting of the lid can be arranged in many ways. One procedure has proven advantageous, according to which the tear-off tongue of the lid slides over a wedge. When the tear-off tongue of the lid has reached the thick of the wedge, the cover is slightly raised. Preferably, the gas is thereby supplied through a boring in the thick wedge end. Another method of lifting the lid, which has proven practically viable, is that the lid is raised by means of the gas nozzle for blowing in the protective gas. For this purpose, the gas nozzle is vertically lifted during the packaging steps and then lowered again. This method will also preferably be implemented in such a manner that the gas nozzle lifts the lid at the tear-off tongue.

THE DRAWINGS

FIG. 1 schematically illustrates a conveyor belt with synthetic material container, partially in section, whereby the protective gas flushing takes place after lifting the lid by means of the gas nozzle in accordance with this invention;

DETAILED DESCRIPTION

Figure 1:
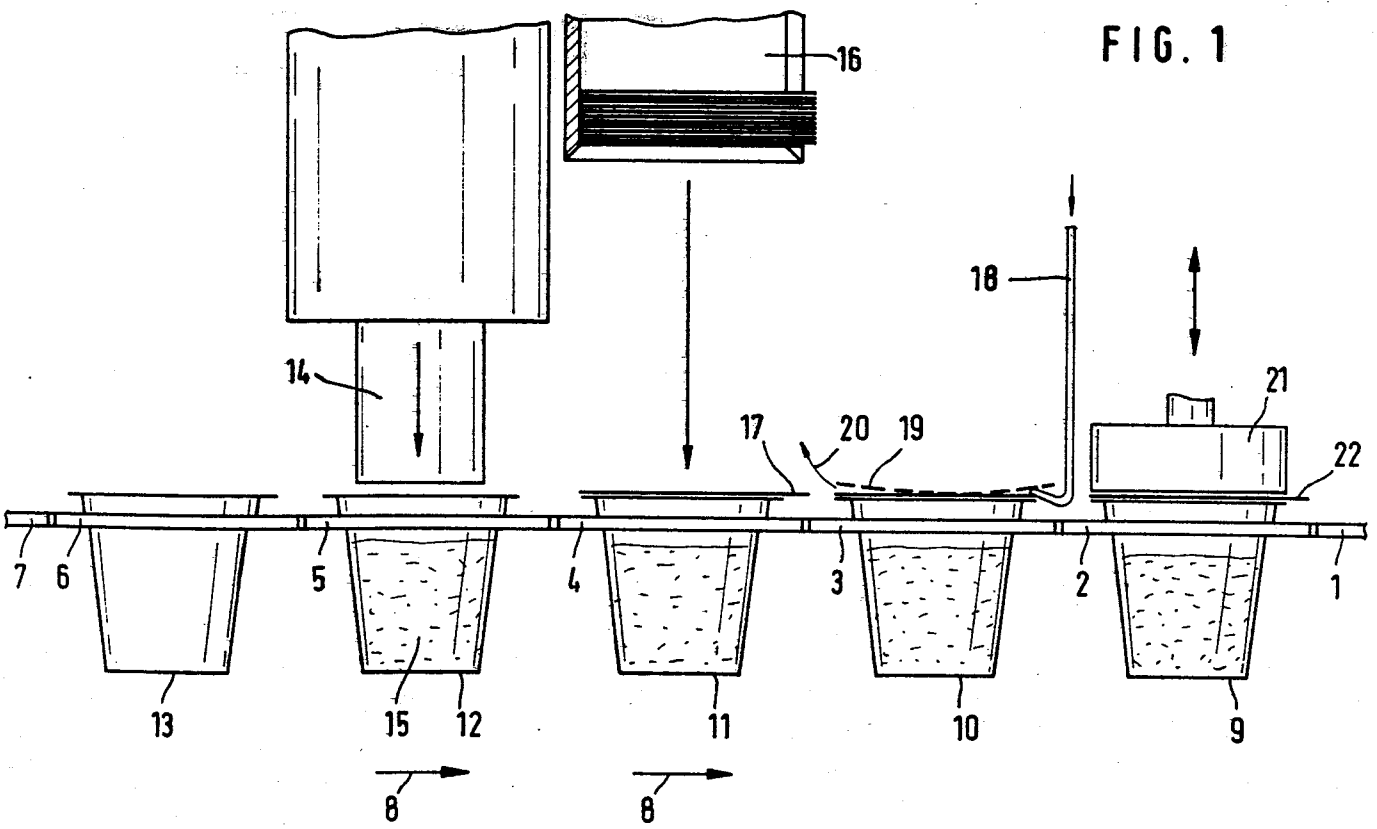

FIG. 1 shows sections 1–7 of conveyor belt, on which the synthetic material containers 9–13 are transported step by step to the individual packaging or work stations. The transport direction is indicated by means of arrows 8. Above the synthetic material container 12, there is a dosage mechanism 14 for the product 15 to be filled into the containers. At the next work station, the supply container 16 for lids is located above the synthetic material container 11. One lid 17 has already been placed on the synthetic material container 11. At the next work station, the flushing with protective gas takes place; the gas being supplied through the gas nozzle 18. The cover 19 on the synthetic material container 10 is represented by a broken line. The lid 19 is slightly raised from the edge of the synthetic material container 10, namely on one side by means of the gas nozzle 18, on the other side by the escaping gas 20. The cover 19 is affixed on the edge of the synthetic material container 10 by means of two holding clamps which are not shown in FIG. 1. Finally, the last work station shows the synthetic material container 9 with the cover 22, which is welded onto the edge of the synthetic material container 9 by means of the welding head 21.

Preferably, the lids 17, 19, and 22 consist of aluminum. However, synthetic material lids can also be used.

Figure 3:
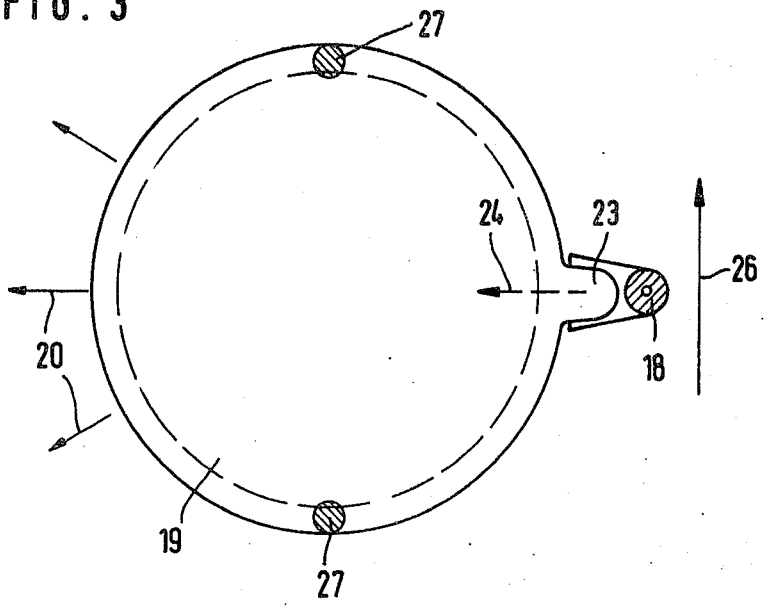
FIG. 3 is a top view of FIG. 2, partially in section.
Figure 2:
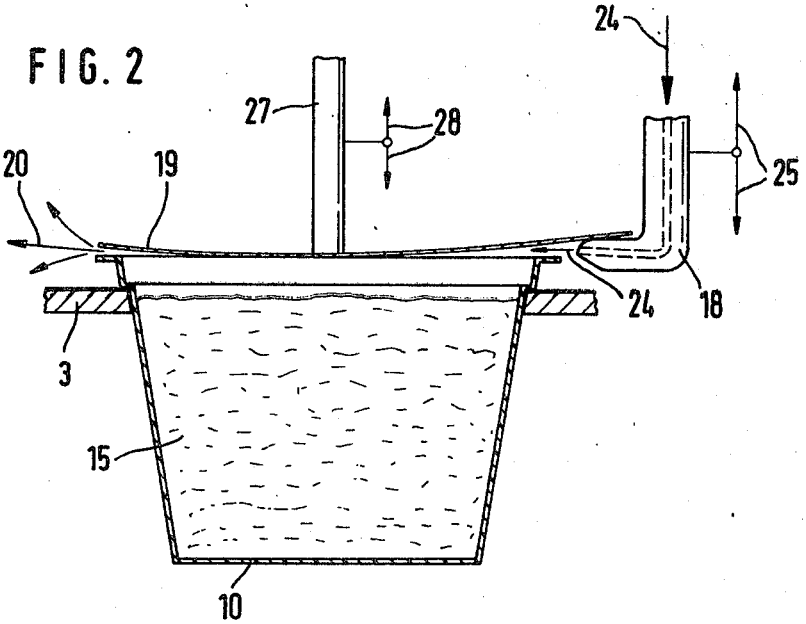
FIG. 2 shows a synthetic material container from FIG. 1, represented in section and in an enlarged detail view at the moment of protective gas flushing.

FIGS. 2 and 3 show, on a larger scale, the flushing, according to the invention, of the headroom of the container 10 from FIG. 1. The cover 19 is slightly raised by an upwards movement of the gas nozzle 18. Preferably, this is done at the tear-off tongue 23. Thereafter, the protective gas is blown in, which is indicated by means of the arrows 24. The gas 20 which escapes from the headroom of the container 10, i.e. air, mixed with protective gas, lifts the lid 19 at the opposite side. After a sufficient quantity of protective gas has been blown in, the gas nozzle 18 is lowered and moved sideways so that the synthetic material container 10 can be conveyed to the next work station in the next step. The vertical movement of the gas nozzle 18 is indicated by an arrow 25 and the sideways movement by an arrow 26. The sideways movement of the gas nozzle 18 is superfluous if the protective gas is blown in from the side of the conveyor belt, i.e. displaced by 90° from the illustrated arrangement. Two holding clamps 27 serve to affix the lid 19 on the edge of the container 10, the vertical movement of said clamps being represented by the arrows 28.

Figure 5:
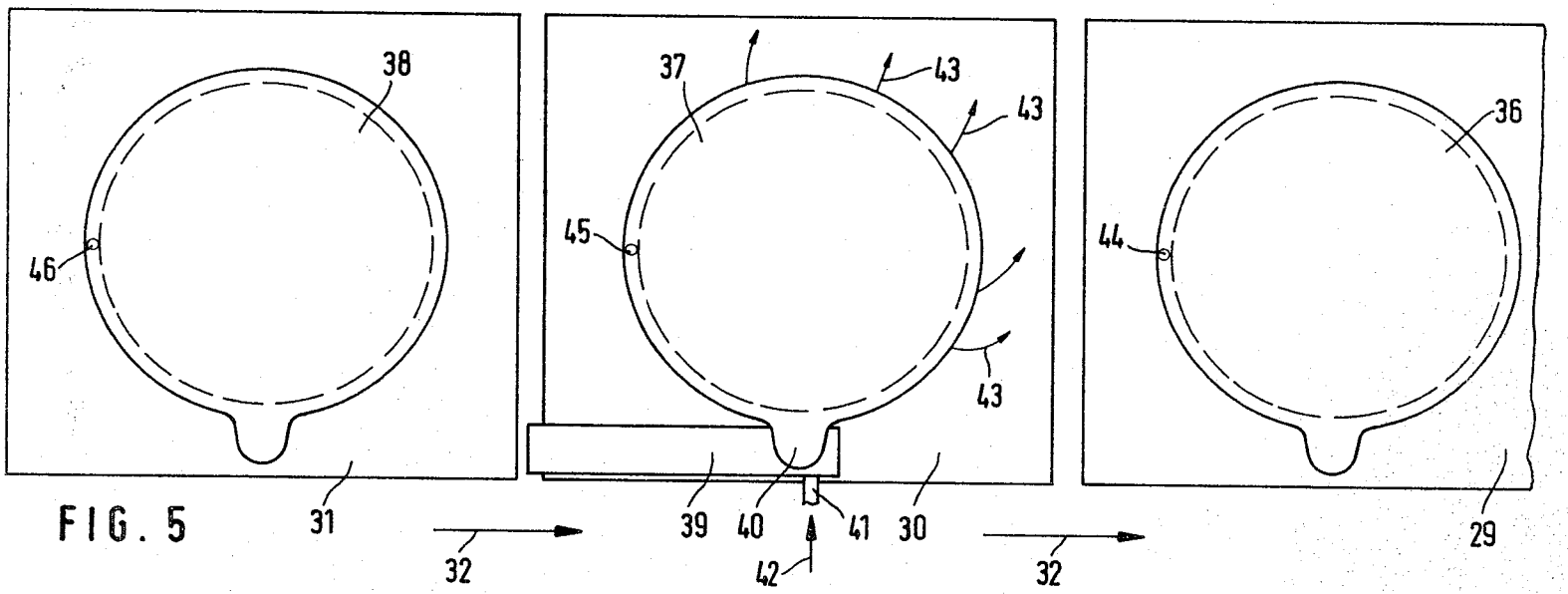
FIG. 5 is a top view of FIG. 4.
Figure 4:
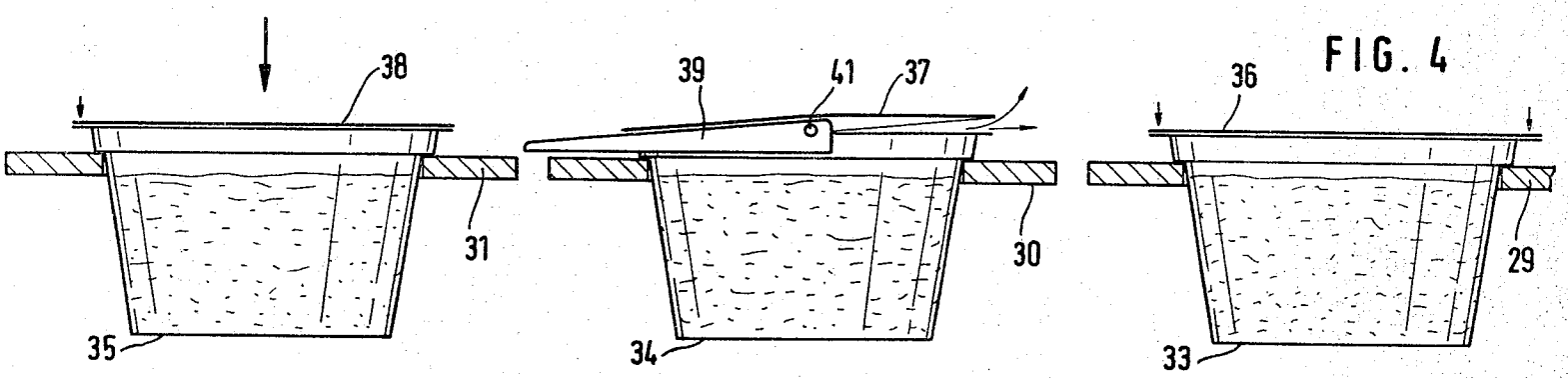
FIG. 4 shows partially in section a conveyor belt with synthetic material containers, where the lifting of the lids is achieved by means of a wedge.

FIGS. 4 and 5 show another execution of the invention. On the sections 29, 30 and 31 of a conveyor belt are the synthetic material containers 33, 34, and 35. The transport direction of the conveyor belt is indicated by the arrows 32. The aluminum lids 36, 37, and 38 are positioned on the synthetic material containers 33–35. The center work station, at which the synthetic material container 34 is positioned, shows the lifting of the cover 37 and theflushing with protective gas according to the invention. A fixed wedge 39 serves to lift the lid 37; when the synthetic material container 34 moves forward, this wedge slides, in the transport direction, under the tear-off tongue of the lid 37 and lifts it slightly, corresponds to its thickness. Through a boring with supply connectors 41 at the thick end of the wedge 39, the protective gas 42 is blown in. The escaping gas is represented by arrows 43. In this variation of the procedure, the fastening of the lids 36, 37, and 38 takes place with spot welds 44, 45, and 46.

The procedure according to the invention practically eliminates the possibility that oxygen from the environment could return into the headroom of the synthetic material container after the flushing with the protective gas. In addition, this is achieved with a quantity of protective gas which is so low that it has previously been considered impossible. In practical application, it has been found that the consumption of protective gas per container is less than three times the volume of the headroom.

Thus the invention deals with the problem wherein the oxygen in the air must be removed from the headroom of the synthetic material containers into which food is filled and which are to be closed by welding on a flexible lid. This is implemented by blowing protective gas into the headroom before the cover is positioned. For this purpose, with the prior art more protective gas is required than corresponds to the volume of the headroom. Furthermore, since some time passes before the cover is put in place, oxygen can re-enter.

In order to reduce the consumption of protective gas and to avoid renewed oxygen infiltration, a cover 17, 36, 37 is placed on the container filled with food and affixed at least in one place on the edge of the container 27, 44, 45, 46. Thereafter, the cover is slightly raised on one side, preferably at the tear-off tongue 23, 40 and the protective gas 24,42 is blown in through the opening formed in this manner. Thereafter, the lid is welded on. The lifting of the lid can be achieved, for instance, by means of a wedge 39 over which the tear-off tongue 40 slides, or by means of the gas nozzle 18 for blowing in the protective gas.

What is claimed is:

1. In a procedure for packaging of food under protective gas in synthetic material containers with flexible lids sealed to the rims of the containers where the packaging steps include product filling, protective gas flushing, lid application, and lid sealing; the improvement being in that the packaging steps are performed in the sequence of product filling and then lid application and then flushing with protective gas and then sealing of the lids, the packaging steps being performed to the container while the container is mounted to a movable conveyor, the lid, relative to the movement of the conveyor having upstream and downstream portions and side portions intermediate thereof, the lid application step comprising placing the lid on the container rim so that the lid lies flat on the container, securing the flat-oriented lid to the container at selected spots on the rim thereof intermediate the upstream and downstream portions of the lid, the upstream portion of the lid having a tear-off tongue projecting beyond the container rim, the protective flushing gas step comprising placing a protective flushing gas nozzle beneath the tear-off tongue, raising the nozzle to lift the tear-off and create flow communication between the nozzle and the container head space while the container is stationary, blowing the protective flushing gas through the nozzle and into the head space, utilizing the escaping air from the head space to raise the lid at an unsecured location remote from the tear-off tongue, lowering the nozzle and moving the nozzle sideways out of the path of movement of the container to permit the lid to return to its flat condition, and moving the container to the lid sealing station.

2. Procedure according to claim 1, characterized thereby that the lid is secured on the rim of the container by means of at least one holding clamp.

3. Procedure according to claim 1, characterized thereby that the container is of circular cross-section.

4. In a procedure for packaging a food under protective gas in synthetic material containers with flexible lids sealed to the rims of the containers where the packaging steps include product filling, protective gas flushing, lid application, and lid sealing; the improvement being in that the packaging steps are performed in the sequence of product filling and then lid application and then flushing with protective gas and then sealing of the lids, the packaging steps being performed to the container while the container is mounted to a movable conveyor, the lid, relative to the movement of the conveyor, having upstream and downstream ends and side portions intermediate thereof, the lid having a tear-off tongue located at one of the side portions and projecting beyond the rim of the container, the lid application step comprising placing the lid on the container rim so that the lid lies flat on the container, securing the flat-oriented lid to the container at one of the ends of the lid, the protective gas flushing step comprising positioning a fixed wedge in the path of motion of the container located to have the narrow end of the wedge slide beneath the tear-off tongue of the lid, raising the tear-off tongue away from the container as the tear-off tongue slides upwardly along the wedge to expose the head space of the container to the thick end of the wedge, the thick end of the wedge having a bore in flow communication with a protective flushing gas nozzle, blowing the protective gas from the nozzle and through the bore into the head space of the container, utilizing the escaping air from the head space to raise the lid at an unsecured location remote from the tear-off tongue, and permitting the lid to return to its flat condition as the container moves away from the wedge and to the lid sealing station.

5. Procedure according to claim 4, characterized thereby that the lid is secured to the rim of the container by means of at least one spot welding.

6. Procedure according to claim 4, characterized thereby that the container is of circular cross-section.

* * * * *